US006328236B1

(12) United States Patent
Upson

(10) Patent No.: US 6,328,236 B1
(45) Date of Patent: Dec. 11, 2001

(54) ICE SHAVING APPARATUS

(75) Inventor: Lee Upson, Sylva, NC (US)

(73) Assignee: Chuckwagon Industries, Inc., Jacksonville, FL (US)

( * ) Notice: Subject to any disclaimer, the term of this patent is extended or adjusted under 35 U.S.C. 154(b) by 0 days.

(21) Appl. No.: 09/293,544

(22) Filed: Apr. 16, 1999

(Under 37 CFR 1.47)

Related U.S. Application Data

(60) Provisional application No. 60/082,148, filed on Apr. 17, 1998.

(51) Int. Cl.[7] ..... B02C 19/12

(52) U.S. Cl. ..... 241/95; 241/DIG. 17

(58) Field of Search ..... 241/95, DIG. 17, 241/282

(56) References Cited

U.S. PATENT DOCUMENTS 2,627,377 * 2/1953 Fletcher ..... 241/95
3,105,643 * 10/1963 Todd ..... 241/95
4,569,266 * 2/1986 Ando ..... 241/95

* cited by examiner

*Primary Examiner*—Mark Rosenbaum
(74) *Attorney, Agent, or Firm*—Thomas C. Saitta

(57) ABSTRACT

An ice shaving apparatus which causes an ice block to be rotated against a cutting blade, the apparatus having a motor which rotates a shaft joined to a drive plate which retains the ice block, the shaft being joined to a piston head within a cylinder, where an air pump provides pneumatic pressure to move the piston head vertically in the axial direction within the cylinder to move the ice block in the axial direction against the cutting blade as the lower surface of the ice block is removed by rotational movement. The air pump is regulated such that a constant pressure is maintained against the piston head.

12 Claims, 1 Drawing Sheet

ICE SHAVING APPARATUS

This application claims the benefit of U.S. Provisional Application No. 60/082,148, filed Apr. 17, 1998.

BACKGROUND OF THE INVENTION

This invention relates generally to the field of machines used to shave blocks of ice to create small ice particles or shavings for use in drinks or the like. More particularly, the invention relates to such machines which include a means to rotate a block of ice against a shaving plate or blade and a means to press the ice against the blade in the direction of the rotational axis. Even more particularly, the invention relates to such machines where the ice block is axially moved by pneumatic means so that constant pressure is exerted against the ice block during the rotational movement.

There are known ice shaving machines which shave or cut small pieces of ice from a large block of ice so that the shaved ice pieces can be used in drinks or the like. The machines must provide means to move the ice block to the shaving blade as the surface of the ice block is shaved off as well as means to rotate the ice block against the blade to cut the shavings. Typically these two steps are accomplished by providing a mechanical screw drive apparatus where the ice block is temporarily attached to a spiked holder connected to the screw drive. A motor turns the screw which simultaneously rotates the ice block against the cutting blade while advancing the block toward the blade along the rotational axis. These machines produce very poor quality ice shavings with much variation in the size and configuration of the shavings. This is because it is difficult to calibrate the screw drive relative to the shaving action such that axial movement occurs at a steady rate. In other words, the pressure exerted on the ice block, which determines the quality of the shavings, varies greatly during the shaving operation. In addition, because of the mechanical nature of the machines, they are relatively expensive to manufacture and are subject to excessive rates of failure because of the variable stresses exerted on the screw drive mechanism.

It is an object of this invention to provide an ice shaving apparatus which delivers constant pressure against the ice block and shaving blade, such that the quality of the shavings is maximized. It is a further object to provide such an apparatus which is relatively simple to manufacture, is less subject to failure and is easy to operate. These and other objects are realized by providing an ice shaving apparatus where the axial force is supplied pneumatically by pumping air against a piston, where the shaft of the piston is rotated by a separate motor and pulley combination, with the free end of the shaft having a spiked drive plate to grip the ice block.

SUMMARY OF THE INVENTION

The invention is an ice shaving machine or apparatus comprising in general a housing to contain the operational components of the invention, a means to retain an ice block, a means to rotate the ice block against a cutting or shaving plate or blade, and a means to continuously force the ice block against the blade in the direction perpendicular to the plane of rotation as the surface of the ice is removed by the blade. The housing is divided generally into three main sections - an upper section containing the operational components, a middle section containing the ice block retaining means and shaving blade, and a bottom section to receive the shaved ice particles. The ice block retaining means is connected to a rotatable shaft of a piston assembly which extends into the middle section of the housing and has a means to temporarily grip the ice block, such as a spiked drive plate. The drive plate and the shaft are rotated by a gear or pulley assembly which is powered by an electric motor. The shaft is free to move vertically along the axis of rotation relative to the housing, with the upper end of the shaft rotatably mounted within a piston head such that the shaft can rotate while the piston head remains stationary. The piston is mounted within a closed cylinder, such that the shaft extends through a small aperture between the upper and middle sections of the housing. The piston is able to travel vertically within the piston cylinder, and is moved vertically downward by air pressure supplied against the upper side of the piston head by an air pump. The pressure exerted against the piston head is monitored and regulated such that it remains relatively constant. The shaving blade is positioned beneath the ice block between the middle and lower sections of the housing. Thus, as the ice block is rotated by the electric motor, the downward force on the ice block is steady as the lower surface is shaved by the blade.

DETAILED DESCRIPTION OF THE INVENTION

Figure 1:
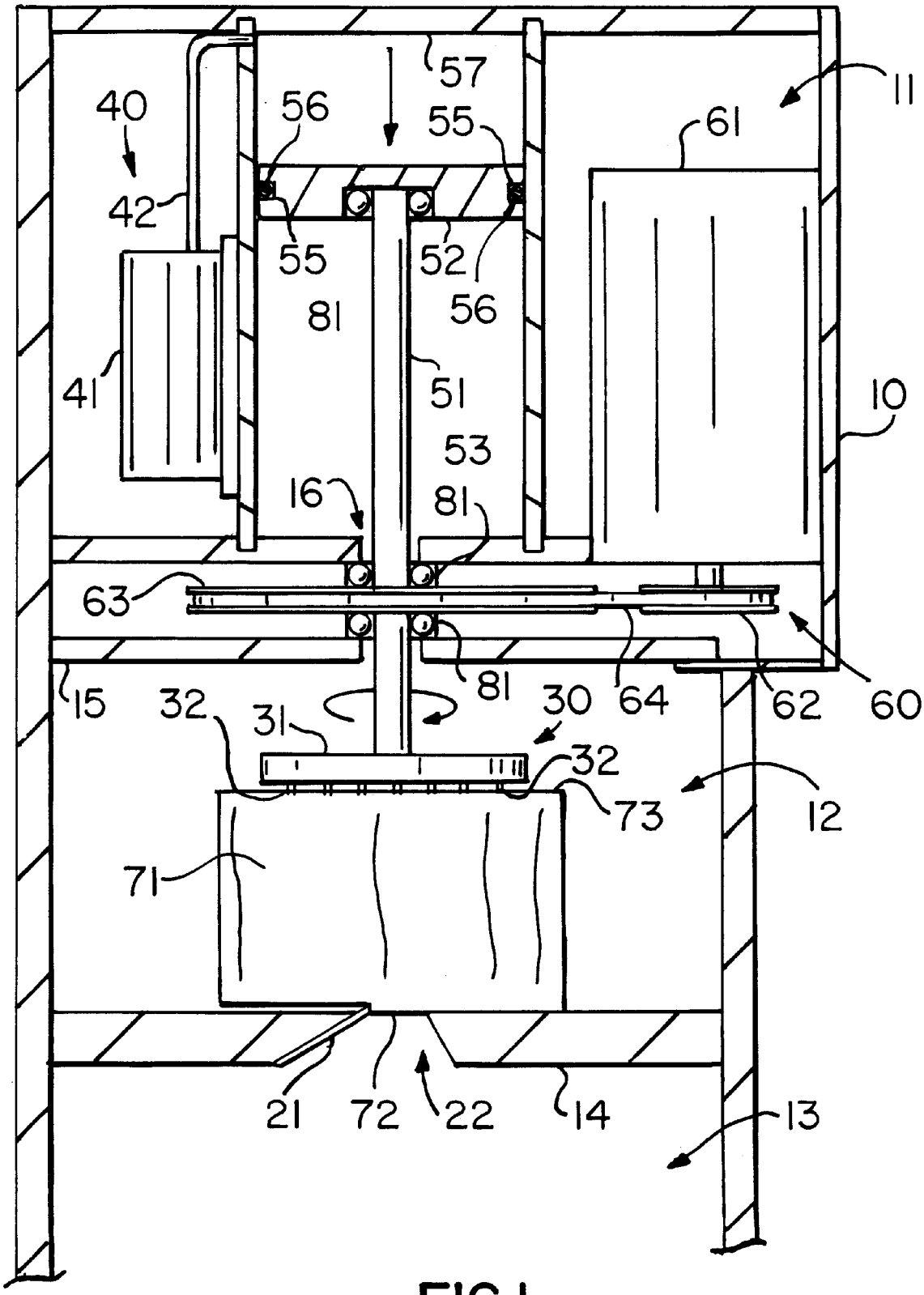
FIG. 1 is a drawing of the invention with the housing and other components shown in cross-section to expose the internal components.

With reference to the drawing, the invention will now be described in detail with regard for the best mode and the preferred embodiment. In general, the invention is an ice shaving machine or apparatus used to create small, shaved, generally uniform, ice particles from a larger block of ice.

The apparatus comprises a housing 10 which is divided into three main sections, an upper section 11 which contains the operational components of the machine, a middle section 12 which receives the block of ice 71, and a lower section 13 where the ice shavings are collected. The housing 10 may be formed of any suitable material such as metal, plastic, fiberglass or the like. A lower interior wall 14 extends horizontally and separates the middle section 12 from the lower section 13. Lower interior wall 14 provides a support against which the ice block 71 is pressed and rotated. A shaving or cutting blade or sharpened plate 21 is mounted onto the interior wall 14 at an angle such that the cutting portion of the blade 21 extends at an acute angle a small distance into the middle section 12 to contact the lower face of the ice block 71. Adjacent the shaving blade 21 in interior wall 14 is a chute or aperture 22 through which the ice shavings fall into the lower section 13. A removable container may be positioned within the lower section 13 to retain the ice shavings.

The ice block 71 is connected to the operational components by a means to retain the ice block 30, which as shown may comprise a horizontally disposed drive plate 31 having depending, relatively sharp, spikes 32 made of metal or other suitably hard material mounted on the underside of the drive plate 31. The spikes 32 are pressed into the ice block 71 and temporarily connect the ice block to the drive plate 31, such any vertical or rotational motion of the drive plate 31 is transferred to the ice block 71. The drive plate 31 is connected to a vertically oriented rotating shaft 51 which extends from the middle section 12 into the upper section 11 through a shaft aperture 16 centrally located in an upper interior wall 15 positioned between the upper section 11 and the middle section 12.

Means 60 to rotate the ice block 71 in a plane about a generally vertical axis are provided, which as shown comprises a power means such as a motor 61, preferably electrically powered, a shaft wheel 63, comprising a pulley or a gear, connected to the shaft 51, a smaller drive wheel 62, which comprises a pulley or a gear complementing the structure of the shaft wheel 63, such that the motor 61 rotates the drive wheel 62 which rotates the shaft wheel 63 and the shaft 51. As shown in the drawing, the rotation means 60 comprises a pulley drive wheel 62 connected by a belt 64 to the pulley shaft wheel 63. In this manner the shaft 51, which is mounted within bearings 81 for stability, can be rotated by the rotation means 60, which in turn rotates the drive plate 31 and the attached ice block 71 about the vertical axis defined by the shaft 51, such that the lower surface 72 of the ice block 71 is translated across the shaving blade 21.

The upper end of the rotating shaft 51 is connected to a piston head 52 mounted within a cylinder 53 in the upper section 11. The shaft 51 is preferably mounted within bearings 81 within the piston head 52 so that the shaft 51 rotates independently of the piston head 52. A seal member 55, such as an O-ring mounted in a groove or O-ring seat 56 on the outer perimeter of the piston head 52, insures that a gas-tight seal is present between the sides of the piston head 52 and the interior walls of cylinder 53. The piston head 52 and shaft are reciprocatingly movable within the cylinder 53, meaning that the drive plate 31 and ice block 71 can be moved in the axial or vertical direction relative to the shaving blade 21 at the same time as it is being rotated.

Means 40 to move the ice block 71 axially are provided separate from and independent of the means 60 to rotate the ice block 71, and preferably is a pneumatic power means comprising an air pump 41 which delivers air under pressure through conduit 42 into the closed top 57 of cylinder 53 above the piston head 52. Pneumatic axial movement means 40 is preferred over mechanical or electrical means 40 because the pneumatic apparatus allows for more precise and steadier control of the pressure exerted against the piston head 52. The air pump 41 is regulated using known components such that a relatively constant pneumatic pressure is applied by the air pump 41 against the piston head 52, preferably a pressure of about 40 psi. Because the force in the downward axial direction is supplied pneumatically, the downward force exerted by the ice block 71 against the shaving blade 21 will remain relatively constant even with the rotational movement of the ice block 71 driven independently by rotation means 60.

To operate the apparatus, an ice block 71 is attached to the drive plate 31 within middle section 12 by pressing the upper surface 73 of the ice block 71 against and onto the spikes 32 extending from drive plate 31. The air pump 41 is activated to apply downward pressure against the piston head 52, which forces the shaft 51, the drive plate 31 and the ice block 71 downward in the axial direction against the shaving blade 21 and the lower interior wall 14. The motor 61 is also activated, which rotates the shaft wheel 63, the shaft 51, the drive plate 31 and the attached ice block 71, such that the lower surface of the ice block 71 is brought continuously across the shaving blade 21, which creates ice shavings of generally consistent and uniform quality, the shavings falling through the chute 22 into the lower section 13 of the housing 10. As the lower surface 72 of the ice block 71 is removed, the pneumatic pressure continuously and steadily presses the ice block 71 downward such that the desired contact force is maintained between the blade 21 and the ice block lower surface 71.

It is understood that certain equivalents and substitutes for some elements set forth above may be obvious to those skilled in the art, and thus the true scope and definition of the invention is to be as set forth in the following claims.

I claim:

1. An ice shaving apparatus for shaving small particles of ice from an ice block, the apparatus comprising ice block retaining means to retain an ice block having an upper surface and a lower surface, a blade to shave ice from said lower surface of said ice block, rotation means to rotate said ice block about an axis, and a separate axial movement means to move said ice block in the axial direction perpendicular to the plane of rotation such that said lower surface of said ice block contacts said blade where said axial movement means is pneumatically powered and regulated to apply constant pressure against said ice block when said ice block is rotated by said rotation means.

2. The apparatus of claim 1, where said axial movement means comprises a shaft connected to a piston head within a cylinder and connected to said ice block retaining means, and an air pump which directs air pressure against said piston head to move said shaft in the axial direction.

3. The apparatus of claim 2, where said rotation means comprises an electric motor.

4. The apparatus of claim 3, where said rotation means further comprises a shaft wheel connected to said shaft and a drive wheel connected to said electric motor, where said electric motor rotates said drive wheel which rotates said shaft wheel and said shaft.

5. The apparatus of claim 4, where said ice block retaining means comprises a drive plate and depending spikes which attach to said ice block upper surface.

6. The apparatus of claim 5, further comprising a housing comprising an upper section, a middle section and a lower section, where said rotation means and said axial movement means are positioned within said upper section, said ice block retaining means and said blade are positioned within said middle section, and where said shaved ice particles fall into said lower section.

7. An ice shaving apparatus for shaving ice particles from an ice block having a lower surface and an upper surface, the apparatus comprising:

a housing having an upper section, a middle section and a lower section, where said upper section is separated from said middle section by an upper interior wall and said middle section is separated from said lower section by a lower interior wall, said upper interior wall having an aperture to receive a shaft, said lower interior wall having a chute to allow shaved ice particles to fall into said lower section;

a cutting blade mounted onto said lower interior wall adjacent said chute;

rotation means to rotate said ice block such that said lower surface of said ice block contacts said cutting blade such that ice particles are shaved from said lower surface and fall through said chute into said lower section;

axial movement means to move said ice block in the axial direction perpendicular to the plane of rotation and comprising a shaft which rotates and moves axially where said axial movement means is pneumatically powered and regulated to apply constant pressure against said ice block when said ice block is rotated by said rotation means; and ice block retaining means connected to said shaft and positioned within said middle section.

8. The apparatus of claim 7, where said axial movement means further comprises a piston head connected to said shaft and mounted within a cylinder positioned within said upper section, and an air pump which directs air pressure against said piston head to move said piston head and said shaft axially relative to said cylinder, such that said ice block retaining means moves axially downward relative to said upper interior wall.

9. The apparatus of claim 8, where said rotation means comprises an electric motor.

10. The apparatus of claim 9, where said rotation means further comprises a shaft wheel mounted onto said shaft, a drive wheel connected to said shaft wheel and to said electric motor, such that operation of said electric motor causes said shaft and said ice block retaining means to rotate.

11. The apparatus of claim 10, where said ice block retaining means comprises a drive plate to which are connected spikes.

12. An ice shaving apparatus comprising:

a housing having an upper section, a middle section and a lower section, where said upper section is separated from said middle section by an upper interior wall and said middle section is separated from said lower section by a lower interior wall, said upper interior wall having an aperture containing bearings to receive a shaft in a manner allowing said shaft to rotate and to move axially in the direction perpendicular to the plane of rotation, said lower interior wall having a chute to allow shaved ice particles to fall into said lower section;

a cutting blade mounted at an acute angle onto said lower interior wall adjacent said chute such that said blade extends a short distance into said middle section;

rotation means to rotate an ice block having a lower surface and an upper surface such that said lower surface of said ice block contacts said cutting blade such that ice particles are shaved from said lower surface and fall through said chute into said lower section, said rotation means comprising an electric motor which is connected to the shaft extending between said upper section and said middle section;

axial movement means to move said ice block in the axial direction perpendicular to the plane of rotation and comprising a shaft which rotates and moves axially, said axial movement means comprising a cylinder mounted within said upper section and a piston head contained within said cylinder and connected to said shaft, and an air pump to provide air pressure against said piston head to move said piston head and said shaft in the axial direction where said axial movement means is regulated to apply constant air pressure against said piston head when said ice block is rotated by said rotation means; and ice block retaining means connected to said shaft and positioned within said middle section, said ice block retaining means comprising a drive plate having spikes depending therefrom.

* * * * *